US008985478B2

(12) United States Patent
Wurz

(10) Patent No.: US 8,985,478 B2
(45) Date of Patent: Mar. 24, 2015

(54) SPRAY NOZZLE, SPRAY DEVICE AND METHOD FOR OPERATING A SPRAY NOZZLE AND A SPRAY DEVICE

(71) Applicant: Dieter Wurz, Baden-Baden (DE)

(72) Inventor: Dieter Wurz, Baden-Baden (DE)

( * ) Notice: Subject to any disclaimer, the term of this patent is extended or adjusted under 35 U.S.C. 154(b) by 12 days.

(21) Appl. No.: 13/771,849

(22) Filed: Feb. 20, 2013

(65) Prior Publication Data

US 2013/0161408 A1 Jun. 27, 2013

Related U.S. Application Data

(63) Continuation of application No. 11/919,868, filed as application No. PCT/EP2006/004220 on May 5, 2006, now Pat. No. 8,453,945.

(30) Foreign Application Priority Data

May 6, 2005 (DE) ..... 10 2005 021 650
Aug. 9, 2005 (DE) ..... 10 2005 037 991

(51) Int. Cl.

| | |
|---|---|
| ***A62C 5/02*** | (2006.01) |
| ***B05B 15/02*** | (2006.01) |
| ***B05B 7/12*** | (2006.01) |
| ***B05B 7/06*** | (2006.01) |
| ***B05B 7/04*** | (2006.01) |
| ***B05B 1/08*** | (2006.01) |
| ***B05B 1/14*** | (2006.01) |

(Continued)

(52) U.S. Cl.

CPC ..... *B05B 7/0458* (2013.01); *B05B 7/0416* (2013.01); *B05B 7/2489* (2013.01); *B05B 7/2491* (2013.01)

USPC ..... 239/8; 239/112; 239/119; 239/416.4; 239/416.5; 239/424; 239/429; 239/434; 239/589.1; 239/590; 239/601

(58) Field of Classification Search

USPC ..... 239/8, 143, 589.1, 590, 601, 104–123, 239/398–434.5

See application file for complete search history.

(56) References Cited

U.S. PATENT DOCUMENTS

| | | | |
|---|---|---|---|
| 733,463 | A | 7/1903 | Dennison |
| 733,579 | A | 7/1903 | Fitton |
| 2,893,646 | A | 7/1959 | Batts |

(Continued)

FOREIGN PATENT DOCUMENTS

| | | |
|---|---|---|
| DE | 27 47 707 A1 | 4/1979 |
| DE | 42 31 119 C1 | 4/1994 |

(Continued)

OTHER PUBLICATIONS

International Search Report dated Jul. 19, 2006 (4 pages).

(Continued)

*Primary Examiner* — Len Tran
*Assistant Examiner* — Steven M Cernoch
(74) *Attorney, Agent, or Firm* — Flynn, Thiel, Boutell & Tanis, P.C.

(57) ABSTRACT

A spray nozzle for two-component flue gas cleaning nozzles. The spray nozzle includes an output or mixing chamber and at least two through bores which lead to the output or mixing chamber and are each connected to a fluid line. At least one through bore is embodied in such a way that it is self-cleaning and/or a cleaning device is provided for at least one through bore.

5 Claims, 4 Drawing Sheets

(51) Int. Cl.
*B05B 1/26* (2006.01)
*B05B 7/24* (2006.01)

(56) References Cited

U.S. PATENT DOCUMENTS

| | | | | | |
|---|---|---|---|---|---|
| 3,228,611 | A | | 1/1966 | Russell | |
| 3,272,441 | A | | 9/1966 | Davis, Sr. et al. | |
| 4,203,717 | A | | 5/1980 | Facco et al. | |
| 4,341,347 | A | | 7/1982 | DeVittorio | |
| 4,548,359 | A | | 10/1985 | Kriebel et al. | |
| 4,638,945 | A | | 1/1987 | Toda et al. | |
| 4,881,563 | A | * | 11/1989 | Christian | 134/166 C |
| 5,035,256 | A | | 7/1991 | Le Devehat | |
| 5,113,895 | A | | 5/1992 | Le Devehat | |
| 5,154,347 | A | | 10/1992 | Vijay | |
| 5,188,296 | A | | 2/1993 | Duez et al. | |
| 5,447,567 | A | | 9/1995 | Tanaka et al. | |
| 5,509,849 | A | | 4/1996 | Spears, Jr. | |
| 5,676,756 | A | | 10/1997 | Murate et al. | |
| 5,709,749 | A | * | 1/1998 | Dion et al. | 118/302 |
| 5,899,387 | A | | 5/1999 | Haruch | |
| 5,938,120 | A | | 8/1999 | Martin et al. | |
| 5,964,418 | A | | 10/1999 | Scarpa et al. | |
| 6,036,111 | A | | 3/2000 | Abplanalp | |
| 6,037,010 | A | * | 3/2000 | Kahmann et al. | 427/426 |
| 6,050,499 | A | | 4/2000 | Takayama et al. | |
| 6,056,208 | A | | 5/2000 | Pirker et al. | |
| 6,062,493 | A | | 5/2000 | Abplanalp | |
| 6,161,778 | A | | 12/2000 | Haruch | |
| 6,254,015 | B1 | | 7/2001 | Abplanalp | |
| 6,286,929 | B1 | | 9/2001 | Sharma et al. | |
| 6,666,386 | B1 | | 12/2003 | Huang | |
| 7,066,186 | B2 | * | 6/2006 | Bahr | 134/56 R |
| 2004/0124269 | A1 | | 7/2004 | Dushkin et al. | |
| 2004/0217185 | A1 | | 11/2004 | Bien | |
| 2004/0251320 | A1 | | 12/2004 | Koponen | |
| 2005/0103883 | A1 | | 5/2005 | Schroeder et al. | |
| 2009/0121038 | A1 | | 5/2009 | Wurz | |

FOREIGN PATENT DOCUMENTS

| | | | |
|---|---|---|---|
| DE | 44 34 067 | A1 | 3/1995 |
| DE | 10 2005 021 650 | A1 | 11/2006 |
| GB | 492 852 | | 9/1938 |
| JP | 53-72213 | | 6/1978 |
| JP | 5-63658 | | 8/1993 |
| JP | 6-7717 | | 1/1994 |
| JP | 2000-229416 | | 8/2000 |
| JP | 2001-276678 | | 10/2001 |
| JP | 2002-504431 | | 2/2002 |
| JP | 2002-79145 | | 3/2002 |
| RU | 2 102 160 | C1 | 1/1998 |
| SU | 1028378 | A | 7/1983 |
| SU | 1260031 | A1 | 9/1986 |
| SU | 1507454 | A1 | 9/1989 |

OTHER PUBLICATIONS

Written Opinion of International Searching Authority (4 pages).
Examination Report from Russian Patent Office dated Apr. 20, 2010 (7 pages) with English translation of excerpt of letter from Russian associate (2 pages).
Translation of Examination Report for Japanese Patent Application No. 2008-509388 mailed Dec. 27, 2011 (5 pages).
German Examination Report for Application No. DE 10 2005 037 991.5 dated Feb. 15, 2013 (6 pages).
Canadian Office Action issued in Appln. No. 2 815 553 dated May 2, 2014 (4 pages).

* cited by examiner

SPRAY NOZZLE, SPRAY DEVICE AND METHOD FOR OPERATING A SPRAY NOZZLE AND A SPRAY DEVICE

CROSS REFERENCE TO RELATED APPLICATION

This application is a continuation of copending application Ser. No. 11/919 868, filed Nov. 2, 2007, which is the national stage of International Application No. PCT/EP2006/004220, filed May 5, 2006, which International Application was not published in English, all of which prior applications are hereby incorporated by referenced herein.

FIELD OF THE INVENTION

The invention relates to a spray nozzle comprising an output or mixing chamber and at least two through bores that lead to the output or mixing chamber, wherein the through bores are respectively connected with a fluid line. The invention also relates to a spray device with a spray nozzle, and a method of operating a spray nozzle and a spray device.

BACKGROUND OF THE INVENTION

For the generation of a possibly fine spectrum of droplets, spray nozzles are used with an output or a mixing chamber and at least two through bores leading to the output or mixing chamber, which are respectively connected with a fluid line, in particular the so-called two-component nozzles. A disadvantage of these two-component nozzles is the proneness to solid sediment, in particular, also in the supply-air bores. Safe operation of two-component nozzles, in many cases, requires frequent removal of the nozzle lances on which spray nozzles are arranged. Only in this manner are nozzles accessible for cleaning according to the state of the art.

In process engineering, in particular, in the case of flue-gas cleaning nozzles are frequently used, which allow very fine atomisation of liquid. Besides high-pressure single-component nozzles, also two-component nozzles are finding increasing application. With such nozzles, also, the liquid is atomised under the influence of a pressurised gas, e.g., compressed air or steam under moderate pressure. With such known two-component nozzles, equipment failures occur relatively frequently through sedimentation in the through bores towards the output or the mixing chamber. Narrow parts of a liquid inlet into the mixing chamber are normally affected, but also, in particular, most radially located bores for introducing compressed air into the mixing chamber are also affected. This compels frequent removal of nozzle lances and cleaning of the nozzles. Since the systems in which the nozzles are fitted, in particular, for flue-gas cleaning cannot be generally shut down for this purpose, these requirements limit the application of the two-component nozzles substantially, since a negative pressure must normally prevail in the system at the nozzle insertion flange, so that hazardous gases cannot exit at the flange briefly opened to remove the nozzle lances. Furthermore, the maintenance work necessitates a significant period. The function of the system can be impaired by the removal of a nozzle lance to facilitate maintenance work.

The object of the invention should broadly inhibit dirt-collection on the spray nozzles, so that long maintenance-free operation intervals of such spray nozzles and spray devices can be achieved.

According to the invention, for this purpose, a spray nozzle with an output or a mixing chamber and at least two through bores leading to the output or to the mixing chamber are provided, wherein the through bores are respectively connected with a fluid line in which at least one of the through bores is formed in a self-cleaning manner and/or devices are provided for cleaning at least one of the through bores.

By means of the spray nozzle according to the invention, the occurrence of sediment on the through bores is prevented in that said bores are made in a self-cleaning manner or additional devices are provided for cleaning at least one of the through bores. The self-cleaning process thereby occurs during a spraying operation and the cleaning devices remove any sediment inside the through bores during the spraying or a cleaning operation.

In a further embodiment of the invention, at least one of the through bores features a tapering cross-section, on its side oriented away from the output or from the mixing chamber, rounded in such a manner that a fluid flow passes the through bore up to the orifice into the mixing chamber, without flow separation/burbling.

The formation of sediment inside the through bores is prevented in this manner, since shearing stress is generated on the bore walls, by the fluid flow in the direction towards the mixing chamber. The wall shearing stress prevents fluid backflow into the bores, so that the formation of sediments is broadly inhibited.

In a further embodiment of the invention, the through bore is rounded like a nozzle on its side oriented away from the mixing chamber.

In this manner, it is reliably prevented that the fluid flow separates from the wall of the through bore.

In a further embodiment of the invention, at least one of the fluid lines is formed as a liquid supply line to the mixing chamber and in an area of at least one through bore, a movable tappet is provided for cleaning inside the liquid inlet bore.

Such a tappet can reliably ensure that any sediment is again dissolved and removed. The tappet, for example, can be actuated by magnetostrictive or hydraulic means.

In a further embodiment of the invention the tappet is located upstream of the liquid inlet bore and formed conical or truncated-cone-like in shape on its end oriented towards the liquid inlet bore.

A reliable cleaning effect is attained by means of such a formation.

In a further embodiment of the invention, the tappet is located in the supply line towards the liquid inlet bore with its longitudinal direction parallel to the flow direction and formed tapering on both ends.

In this manner, the tappet can be shaped for convenient flow and the resistance to flow, caused by the tappet in the liquid supply line, can be kept low.

The conical or truncated-cone-shaped end of the tappet is advantageously matched to an inlet area of the liquid inlet bore, said inlet area tapering in the flow direction.

In a further embodiment of the invention, one of the fluid lines is formed as a liquid supply line and means are provided to apply pressure surges to the liquid in the liquid supply line.

The pressure surges can be used for cleaning the through bores. It is advantageous in the process that no mechanical devices must be introduced into the through bore and that the pressure surges can be applied during the spraying operation.

Advantageously, pressure surges having frequencies in the ultrasonic range are applied. In this manner, possible sediment can be comminuted and carried away via the mixing chamber of the nozzle. In a certain sense, the cleaning effect that occurs is comparable with the ultrasonic comminution of kidney stones.

In a further embodiment of the invention one of the fluid lines is formed as a pressurised gas supply line to a mixing chamber and upstream of the at least one through bore formed as a pressurised gas inlet bore, means are provided for introducing abrasive dust into the pressurised gas supply line.

Sediment can be removed by erosive means of abrasive dust particles. The hardness of fine abrasive dust should be substantially lower than the hardness of the nozzle material.

In a further embodiment of the invention one of the fluid lines is formed as a pressurised gas supply line to a mixing chamber and upstream of the at least one through bore is formed like a pressurised gas inlet bore where means are provided for introducing cleaning liquid into the pressurised gas supply line.

Such a cleaning liquid can for example be demineralised water and the pressurised gas is applied with an aerosol of the cleaning liquid. It can be helpful in the process to apply the cleaning liquid with chemicals to assist the sediment-dissolving process inside the through bores. It is not necessary to dope the atomising air perpetually with cleaning liquid, but rather, in many cases, also intermittent application can be sufficient. If necessary, a separate atomising chamber can be provided to atomise the cleaning liquid into tiny droplets prior to introduction into the pressurised gas supply line.

In a further embodiment of the invention, one of the fluid lines is formed as a pressurised gas supply line to a mixing chamber and upstream of at least one through bore is formed as a pressurised gas inlet where means are provided for introducing foamed or foam-like particles into the pressurised gas supply line, which can be pressed through the pressure inlet bore by means of the pressure of said gas.

By means of such foamed or foam-like particles, for example in spherical shape, sediment or clogging pieces can be removed or prevented. Typically, several pressurised gas inlet bores are provided and the cleaning particles are pressed through all the through bores in accordance with the stochastic natural law.

In a further embodiment of the invention one of the fluid lines is formed as a pressurised gas supply line to a mixing chamber and upstream of the at least one through bore that is formed as a pressurised gas inlet bore, means are provided for introducing steam into the pressurised gas supply line.

The introduction of steam can already generate sufficient cleaning effect.

In a further embodiment of the invention one of the fluid lines is formed as a liquid supply line and the through bore formed as a liquid inlet bore features a constriction, wherein a ratio of length to diameter of the constriction is greater than 1.0, in particular greater than 1.5. Sediments in the liquid inlet bore can lead to the liquid that flows into the mixing chamber to be deflected laterally. Due to the corresponding dimension of the constriction, the liquid jet itself is then broadly fed in to the mixing chamber, centrally and symmetrically when sediment has collected in the form of scales in front of the constriction.

In a further embodiment of the invention one of the fluid lines is formed as a liquid supply line to a mixing chamber and one of the fluid lines as a pressurised gas supply line to the mixing chamber, wherein the pressurised gas supply line surrounds the mixing chamber, at least section wise, in the form of a ring and several through bores that are formed as pressurised gas inlet bores relative to a middle axis of the spray nozzle are arranged radially towards the mixing chamber.

Such a formation allows generation of very fine droplets, and together with the measures according to the invention, dirt-formation is extensively prevented on such a two-component nozzle.

The problem based on the invention is also solved by means of a method for operating a spray nozzle according to the invention, in which the step of introducing a cleaning fluid or cleaning particles in a fluid line that is formed as a pressurised gas supply line upstream of at least one through bore that is formed as a pressurised gas inlet bore is provided into the mixing chamber.

By introducing a cleaning fluid or cleaning particles, any sediment accumulated inside the through bores of the spray nozzle can be removed reliably and for example flushed away together with the spray jet. For example, steam, chemically active cleaning liquid or fine abrasive dust can be introduced upstream of the at least one pressurised gas inlet bore. Alternatively or additionally, it is also possible to introduce foam or foam-like cleaning particles upstream of the at least one pressurised gas inlet bore, which are then pressed through the pressurised gas inlet bores into the mixing chamber, under the effect of the pressurised gas.

In a further embodiment of the invention, it is provided that pressure surges are modulated on the liquid to be atomised in the fluid line formed upstream as the liquid supply line on the at least one through bore formed into the mixing chamber.

By means of such pressure surges, impurity or sediment in the through bores can be dissolved likewise in a reliable manner. For example, pressure surges can be modulated with frequencies in the ultrasonic range, in order to comminute sediment in the through bores or on other parts of the nozzle.

The problem according to the invention is also solved by means of a spray device with a spray nozzle according to the invention in which means are provided in order to cause fluid flow from the mixing or output chamber into the fluid line during a cleaning operation, in at least one of the fluid lines and the associated through bore.

A cleaning effect can be achieved through a fluid flow from the mixing or output chamber into the fluid line. The fluid to be sprayed for instance can be a liquid or a liquid-solid suspension. The spray device according to the invention can be used with two-component nozzles or also with the so-called single-component back-flow nozzles, in which a part of the fluid flowing into the output chamber does not exit the nozzle but rather flows back into a return line. In an extreme case, in the case of single-component back-flow nozzles, the return-flow volume is equal to the supply volume, so that no fluid is injected into gas space. This effect can be used for a cleaning operation. In particular, in two-component nozzles, a reverse flow direction is set in a cleaning operation between a mixing chamber and a liquid supply line or rather, if applicable, a filter is connected downstream in contrast to the spraying operation. By reversing a flow direction in a cleaning operation in contrast to the spraying operation, sediment or clogging pieces can generally be removed in a reliable manner.

In a further embodiment of the invention, the fluid lines feature a pressurised gas supply line to the mixing chamber and a liquid supply line to the mixing chamber and the means for reversing the flow direction in the cleaning operation causes an outward fluid flow from the mixing chamber through the liquid inlet bore and an inward flow into the liquid supply line.

In this manner, the liquid inlet bore can be cleaned reliably in a cleaning operation.

In a further embodiment of the invention, a fluid line formed as a liquid supply line features at least a shut-off valve and at least a cleaning valve located downstream of the shut-off valve in the liquid supply direction.

After opening the cleaning valve, the fluid flowing relative to the spraying operation can be let out through the cleaning valve in the reverse direction, so that possible dirt or sediment can be carried away from the spray device.

In a further embodiment of the invention a negative pressure source is provided, which can be connected by means of the cleaning valve with the liquid supply line.

In this manner, the back-flow amount into the liquid supply line can be increased, but by applying a correspondingly high negative pressure, for example, it can also be prevented that liquid or pressurised gas exits from the output orifice of the nozzle into the process surrounding during the cleaning operation.

In a further embodiment of the invention a sludge-collection tank is provided, which can be connected with the liquid supply line by means of the cleaning valve.

Sediments can be collected in a sludge-collection tank.

In a further embodiment of the invention a filter device is provided, which is serially switched into the liquid supply line and a filter chamber is provided respectively on the upstream and downstream side of a filter insert, wherein both filter chambers may be connected by means of a cleaning valve respectively with a sludge-collecting tank.

In this manner a filter device can also be cleaned in a cleaning operation with reverse flow. The dissolved sediments during a cleaning operation are collected in the filter chamber located downstream in a spraying operation. In normal spraying operation the impurities of the supplied liquid to be sprayed will collect in the filter chamber located upstream. In a cleaning operation, both filter chambers can be emptied and connected, for example, with a sludge-collection tank via the sludge-collection line.

In a further embodiment of the invention one of the fluid lines is formed as a pressurised gas supply line and a means for introducing a cleaning liquid is provided in the pressurised gas supply line.

In a further embodiment of the invention a collection tank is provided for the cleaning liquid and a means for conveying the cleaning liquid from the collection tank is provided in the pressurised gas supply line.

In this manner, the cleaning liquid can be circulated in the spray device according to the invention, for example, for so long until its cleaning effect is exhausted. In this manner, a very economical operation of the spray device according to the invention is possible.

In a further embodiment of the invention means are provided in the liquid supply line, for mixing the cleaning liquid from the collection tank during the spraying operation.

In this manner, effluent-free operation of the spray device according to the invention can be achieved, since the cleaning liquid used for the cleaning operation is first collected in a collection tank and then during the spraying operation metered again into the liquid to be sprayed. The mixing process can thereby occur, in that the cleaning liquid in the spraying operation is drained from the spray nozzle after being diluted up to ineffectiveness. An already existing sludge-collection tank can be used as a collection tank.

The problem on which the invention is based is also solved by a method of operating a spray device according to the invention, in which the step of reversing the fluid-flow direction in a cleaning operation in contrast to a spraying operation is provided in at least one area of the orifice of one of the fluid lines into the mixing or output chamber.

In this manner, impurities that have collected in front of the through bores during the spraying operation are flushed away in the reverse cleaning operation direction.

In a further embodiment of the invention, a fluid line of the spray nozzle is formed as a liquid supply line leading to the mixing chamber and another fluid line as a pressurised gas supply line leading to the mixing chamber and the following steps are provided:

In a cleaning operation, a liquid supply is switched off by means of a shut-off valve in the liquid supply line, and a cleaning valve is opened in the liquid supply direction downstream of the shut-off valve, a cleaning fluid flow is introduced via the gas supply line, and then the mixing chamber in the liquid supply line, then to the cleaning valve.

Through this measure, the cleaning fluid-flow crosses the mixing chamber against the spraying operation in the reverse direction, so that clogging pieces or impurities can be removed from through bores. The cleaning fluid can thereby be pressurised gas that is used during the spraying operation.

In a further embodiment of the invention a negative pressure can be applied at the cleaning valve during the cleaning operation.

In this manner, on the one hand, the change of direction of flow can be supported during the cleaning operation, and it can also be prevented during the cleaning operation that the cleaning fluid exits from the spray nozzle.

In a further embodiment of the invention the cleaning fluid is a mixture of pressurised gas and cleaning liquid. Alternatively, the cleaning fluid can exclusively consist of cleaning liquid. Moreover, during the cleaning operation, the surrounding gas can be sucked through a nozzle output orifice, so that the cleaning fluid contains the surrounding gas. For example, flue gas can be sucked in, if it may be assumed that the properties of the flue gas from the process surrounding does not impair the dissolution of sediment.

In a further embodiment of the invention it is provided that the cleaning fluid circulates from the cleaning valve to the pressurised gas line through the mixing chamber and the liquid supply line and back to the cleaning valve.

In this manner the cleaning fluid can be used several times. The cleaning fluid can then be collected in a collection tank during the cleaning operation to attain an effluent-free operation during the spraying operation, and again be admixed from the collection tank in the liquid supply line.

Further features and advantages of the invention result from the following description of preferred embodiments of the invention in combination with the drawings. In so-doing, individual features of differently depicted embodiments can be combined with one another in an arbitrary manner, without departing from the scope of the invention. The drawings show:

DETAILED DESCRIPTION

Figure 1:
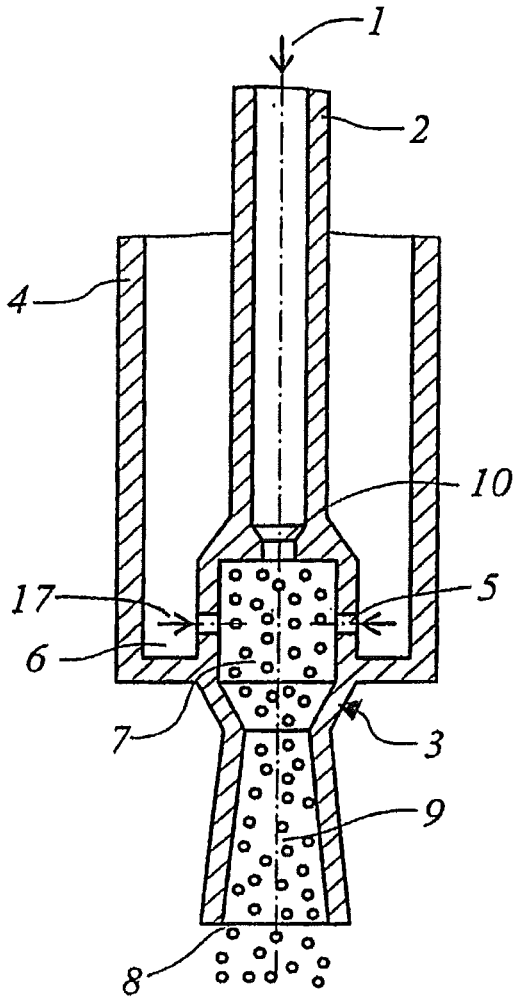
FIG. 1 is a sectional view of a two-component nozzle according to the state of the art.

FIG. 1 shows the design of a known two-component nozzle according to the state of the art, in a schematic sectional view. A liquid 1 to be atomised is supplied via a pipe 2 of the broadly two-component nozzle 3 in a centrally symmetrical manner, whereas pressurised gas 17 is blown in via the bores 5 from an outer ring space 6 into a mixing chamber 7. With the depicted nozzle, the supply pipe 2 for the liquid inside the pipe 4 is meant for the supply line of the pressurised gas. This, however, is not binding at all. Via a nozzle orifice 8, a two-component mixture 9 of atomising gas and droplets exits the mixing chamber 7 at a relatively high velocity.

Since the atomising gas consists of compressed air, in most cases, reference is made to air—hereinafter—only for the sake of simplicity.

Figure 2:
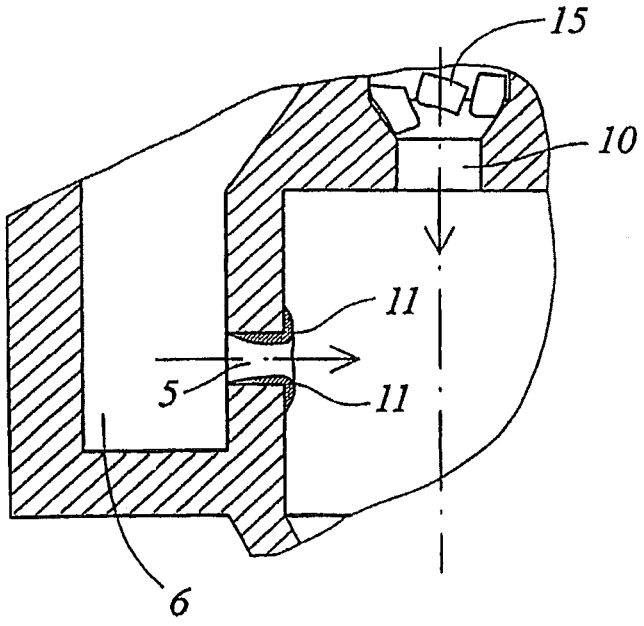
FIG. 2 is a sectional magnification of the sectional view of the two-component nozzle of FIG. 1.

With the known two-component nozzles 3, equipment failures occur relatively frequently due to sedimentation 11 and 15, as apparent in FIG. 2. Affected parts are a constriction 10 of a liquid inlet bore into the mixing chamber 7, but in particular also radial through bores for the pressurised gas or compressed air inlet into the mixing chamber 7. FIG. 2 illustrates this fact in a sectional magnification.

Such sediments 11, 15 compel one to remove and clean the nozzle lances regularly to clean the nozzles. Since the systems in which the nozzles are fitted, in particular for flue gas cleaning, cannot be generally shut down for this purpose, these requirements limit the application of the two-component nozzles substantially, since a negative pressure must normally prevail in the system at the nozzle insertion flange, so that no hazardous gases can exit at the briefly opened flange in order to remove the nozzle lances. Furthermore, the maintenance work necessitates a significant period of time, and the function of the system can be impaired by the removal of a nozzle lance to facilitate maintenance work.

Figure 3:
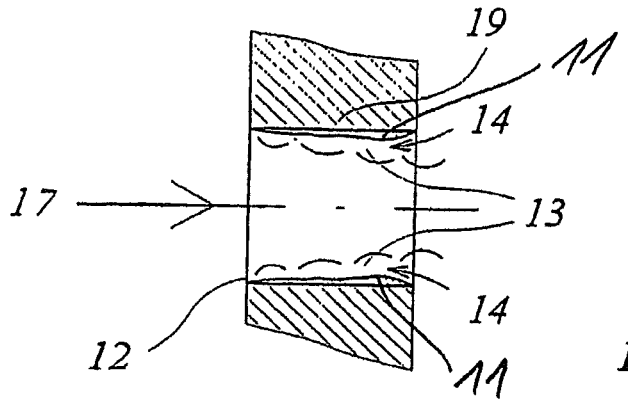
FIG. 3 is a further magnified part of the sectional view of FIG. 1.

As regards the known spray nozzles and in particular the known two-component nozzles 3, the through bores 5 for the pressurised gas are made sharp-edged at the transition point, from one ring chamber 6 to the mixing chamber 7. This results, as depicted in FIG. 3, in that the air-flow along an inlet edge 12 of the through bore 5 forms separation zones 13, which can extend up to the mixing chamber 7. In this ring-shaped separation zone 13, the liquid to be atomised can flow back against the flow direction of air, as outlined by arrow 14, and forms a drying sediment 11 here, which is already depicted in FIG. 2. These sediments 11 reduce the air throughput and compels one to clean the nozzles regularly.

Also at the through bore for introducing the liquid to be sprayed into the mixing chamber 7, a constriction 10 exists generally, which is depicted FIGS. 1 and 2. Sediment 15 can also occur here, in particular of scale sediment that dissolves from wall of the liquid supply lines. These scale sediment 15 collect preferably at a conical constriction, for example, at the transition from the internal diameter of the liquid supply line to the constriction 10.

Figure 4:
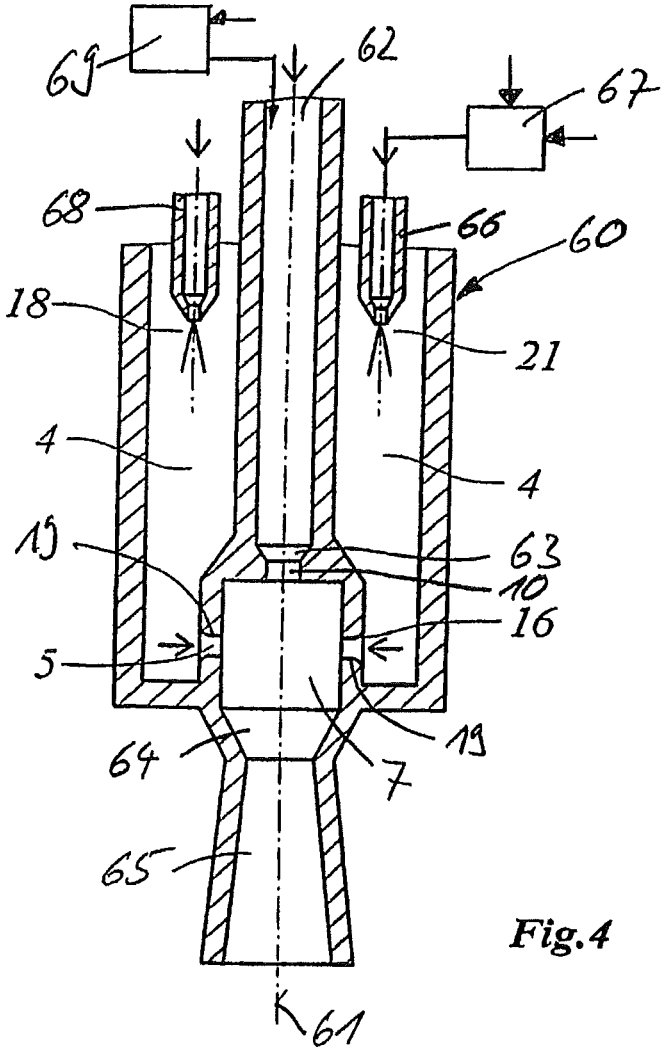
FIG. 4 is a two-component nozzle according to the invention based on a first embodiment of the invention.

The illustration of FIG. 4 shows a first embodiment of a two-component nozzle 60 according to the invention. As can be seen in FIG. 4, the through bores 5 are formed in a wall structure of the nozzle 60 and are for pressurised gas or for compressed air on the side of the pressurised gas supply line and form a ring chamber that surrounds the mixing chamber 7 section-wise. The through bores 5 are provided with a rounded inlet edge 16. In contrast to the illustration of FIG. 3, the inlet edge 16 is not sharp-edged like inlet edge 12 but rounded in form, so that the cross-section of the through bore 5 for the pressurised gas supply line tapers towards the mixing chamber 7, starting from the side oriented away from the mixing chamber 7. This rounded edge 16 causes the air flow not to separate any more from the bore wall. But rather, wall-shearing stress generated by the air flow acts continuously on the bore wall in the nozzle-like through bore 5 in the direction towards the mixing chamber 7. This wall-shearing stress hinders back-flow of liquid from the mixing chamber 7 into the through bores 5, so that the formation of sediments as a result of dried evaporation residue of the liquid is broadly inhibited.

As visible in FIG. 4, the two-component nozzle 60 according to the invention is made axially symmetrical to a middle axis 61. A liquid supply line 62 is routed in the middle through a nozzle body and after a conical-shaped constriction 63 and the cylindrical constriction 10, it leads into the mixing chamber 7. The liquid to be sprayed from the liquid supply line 62 shoots centrally into the mixing chamber 7. A conically shaped bottleneck 64 joins the mixing chamber 7 in the exit direction, which then transforms into a conically enlarged output funnel 65. The pressurised gas supply line 4 is formed as a ring-channel, and surrounds the liquid supply line 62 and surrounds the mixing chamber 7 in its further course section-by-section. In the sidewalls of the cylindrical mixing chamber 7, several through bores 5 are arranged radially, through which, as already explained, pressurised gas from the pressurised gas supply line 4, reaches the mixing chamber. In the mixing chamber 7, the inflowing liquid jet is mixed with the inflowing pressurised gas, so that a spray jet with a fine droplets-spectrum exits from the output funnel 65.

Regardless of the nozzle-shaped, rounded edge 16 of the through bores 5 for pressurised gas, sediment formation inside the through bores 5 cannot be absolutely avoided. This is because the inflowing pressurised gas, for example air, also contains small amounts of fine dust. This can be deposited on the wall of the radially located through bores 5 and forms a kind of capillary pump: In the fine capillaries of dust layer, liquid can be sucked back from the mixing chamber 7 against the flow direction of atomizing air, thus against the pressurised gas coming inside via the radial through bores 5. This leads to the sediment layer becoming thicker. Sediment scales can furthermore form inside the radial through bores 5 during non-steady atomisation processes because of temporary back-flow into the through bores 5 to carry air. With the known two-component nozzles according to the state of the art, as depicted in FIGS. 1 to 3 and that feature sharp inlet edges 12, sediment is even found inside the ring chamber 6, which should actually be exposed only to air flow.

To avoid such sediment inside the through bores 5 or to remove them after their occurrence, it is suggested to dope the atomised liquid with a cleaning liquid 21, preferably with demineralised water. The cleaning liquid 21 is introduced via a nozzle 66 depicted in FIG. 4 into the pressure gas supply line 4 upstream of through bores 5. The cleaning liquid 21 can be introduced near the mixing chamber 7 in the pressurised gas supply line 4. The exposure of pressurised gas, for example air, with the cleaning liquid 21 aerosol can take place at a great distance from the mixing chamber 7. The cleaning liquid 21 is pressed by the atomizing air into the pressurised gas supply line 4 at a high velocity through most, but not forcefully, radially located through bores 5, which are kept free from the sediment scales in this manner. In adjusting to the type of sediment scales inside the through bores 5, it can be helpful to admix the cleaning liquid 21 with chemicals, through which the dissolution process of the sediments 11 is assisted in through bores 5. In so-doing, it is not required to dope the atomizing air continuously with the cleaning liquid 21. Rather, intermittent exposure is sufficient in many cases.

It can be advantageous to atomise the cleaning liquid 21 into small droplets in a separate atomising chamber 67 as outlined schematically in FIG. 4, so that the radial through bores 5 are exposed to air-liquid aerosol-flow.

It can also be sufficient to moisten the atomizing air for example by blowing in steam 18 via a nozzle 68 or even to saturate it with steam. The steam nozzle 68 can likewise be located in the ring-shaped pressurised gas supply line 4. During the expansion of the accelerated compressed air into the through bores 5 into the mixing chamber 7, temperature reduction takes place and thus re-condensation of steam. This mainly occurs, however, outside the boundary layer flow in the case of common prandtl numbers, however, also in little amounts at the walls 19 of the through bores 5. Wetting of bore walls by re-condensate can in many cases cause sufficient cleaning.

In the two-component nozzle 60 of FIG. 4, a further possibility is outlined, in which the sediment scales in the area in front of the constriction 10 of the liquid inlet bore is removed from the mixing chamber 7. In this case, in the illustration of FIG. 4, a diaphragm valve 69 is schematically outlined in the liquid supply line 62, which can be switched off. By means of diaphragm valve 69, it is possible to modulate pressure surges on the liquid to be atomised in the liquid supply line 62, which disintegrates the sediment scales, in particular in the area of the constriction 63 and the constriction 10 of the liquid inlet bore into the mixing chamber 7. To a certain extent, this can be compared with the ultrasonic disintegration of kidney stones.

Instead of the diaphragm valve 69, for example, also an ultrasonic transducer can be used with a suitable ultrasonic converter, which modulates pressure surges in the ultrasonic range and thus caters for cleaning the liquid supply line 62 and, in particular, the constrictions 63 and 10.

Figure 5:
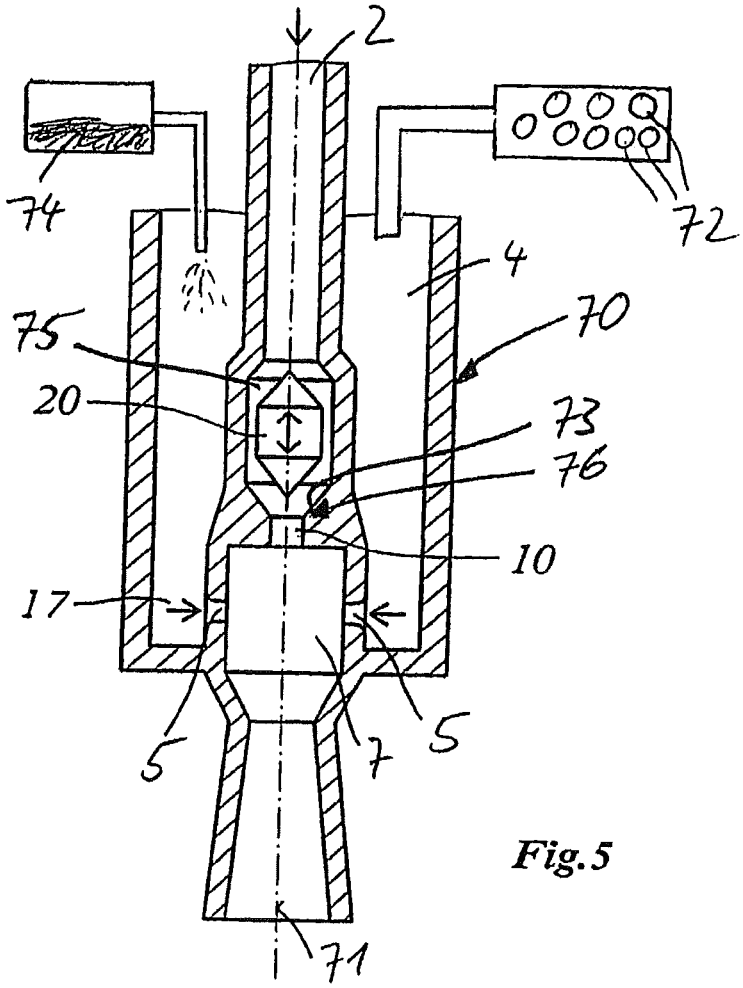
FIG. 5 is a sectional view of a two-component nozzle according to the invention based on a second embodiment.

A further embodiment of a two-component nozzle 70 according to the invention is depicted in the schematic sectional view of FIG. 5. In farther-away parts, the two-component nozzle 70 features an identical design for a two-component nozzle 60 of FIG. 4, so that only the elements different from the two-component nozzle 60 of FIG. 4 are explained in detail.

Alternatively or in additional to the introduction of steam 18 or of cleaning liquid 21, the atomizing air in the pressurised gas supply line 4 can be exposed to small foamed beads 72 as depicted schematically in FIG. 5. These will be introduced in the pressurised gas supply line 4 and then pressed alternately through diverse through bores 5 in accordance with stochastic laws. In this manner, radial through bores 5 are kept free of scales. A comparable method is then exclusively used for cleaning long condenser tubes. The introduction of foamed beads 72 can be applied with or without additional doping with a cleaning liquid 21.

Likewise, alternatively or additionally, the atomizing air can be admixed with abrasive fine dust 74 which also leads to erosive dissolution of sediment scales in the through bores 5. The introducing of such abrasive fine dust 74 is depicted schematically in the illustration of FIG. 5. For this purpose, the hardness of the abrasive fine dust 74 is significantly less than the hardness of nozzle material, so that actually only the sediment scales and not the bore walls are eroded.

Since not only the radial through bores for the supply of atomizing air can be clogged through the formation of sediment scales, but also the through bores 76 for liquid supply with the constriction 10, in particular, as depicted in FIG. 2, through sediment scales 15 from the liquid supply line 2, a cleaning mechanism is provided in the two-component nozzle 70 according to FIG. 5 also for the liquid inlet bore 76. A tappet 20 serves for cleaning the liquid inlet bore 76 in FIG. 5, which is schematically depicted and for example can be moved by magnetostrictive means or by hydraulic means along the double arrow outlined in FIG. 5. By moving the tappet 20 in the manner that this knocks on the truncated cone-shaped bottleneck 73 of the liquid inlet bore, the scales are disintegrated and can be washed away via the mixing chamber 7 through the nozzle 70.

As is visible in FIG. 5, the tappet 20 features a cylindrical base body and tapers on its both ends. The tappet 20 is arranged with its longitudinal axis parallel to the flow direction and concentric to the middle axis 71 of the nozzle 70.

When viewed in the flow direction, the conical constriction of the tappet 20 facing the mixing chamber 7 is adapted to the constriction 73 of the liquid inlet bore 76. In this manner, the tappet 20 in the area of the constriction 73 is flat towards the system and can therefore disintegrate the sediment scales possibly existing there. The design of the tappet 20, constricted on both ends, and their arrangement with its longitudinal axis parallel to the flow direction, results in a smaller flow resistance and thus in a small pressure loss in the liquid supply line 2. The tappet 20 is located movably within a tappet chamber 75 that features an enlarged cross-section relative to that of the liquid supply line 2, and is demarcated by the constrictions 73 and 10 of the liquid inlet bore 76, in the flow direction, viewed towards the mixing chamber.

Figure 6:
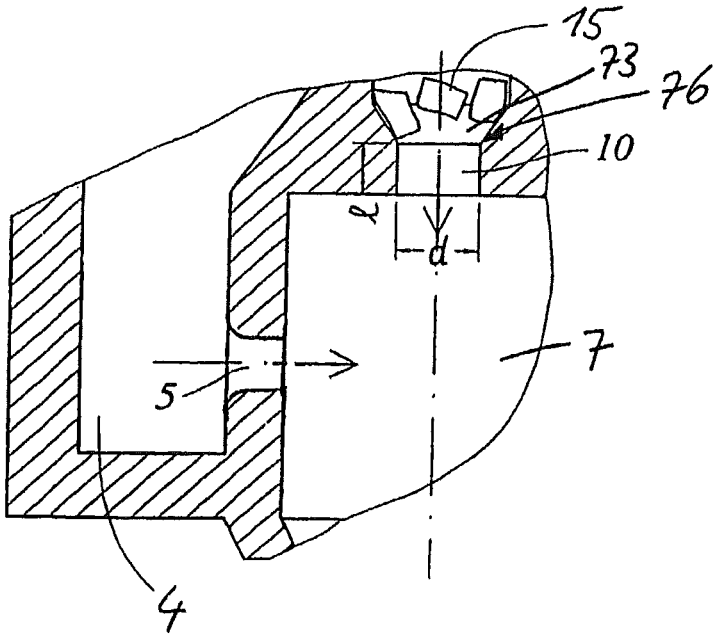
FIG. 6 is a sectional magnification of the sectional view of FIG. 5.

The illustration of FIG. 6 depicts a magnified section of the two-component nozzle 70 of FIG. 5 according to the invention. In the area of the liquid inlet bore 76, plate-shaped sediments 15 are visible, which have deposited in the area of constriction 73, in front of constriction 10. These deposits of sediment in contrast to the sediment deposits that occur at the air-through bore 5 are generally not formed at the liquid inlet bore 76, but to a greater percentage are mostly scales that originate from the elongated pipeline system of the liquid supply as well as in the nozzle lances themselves. Due to vibrations or thermal stresses, such sediments can detach in the form of scales from the walls; they are then entrained by the liquid flow. For a certain size of the liquid inlet bore 76, and in particular, at the constriction 10, they clog the cross-sections due to the scales 15. With this, not only the liquid throughput is throttled in an impermissible manner, but it comes further to the disturbance of the velocity distribution in the mixing chamber 7, since said scales 15 act like small baffle plates, which cause lateral deflection of the liquid jet, so that this no longer shoots centrally and symmetrically into the mixing chamber 7. Therefore, according to the investigations of the inventor, it is advantageous that the ratio of length 1 to diameter d at the constriction 10 is chosen greater than 1 and particularly greater than 1.5. In this manner, the liquid jet from the liquid inlet bore 74 itself is then guided mostly centrally and symmetrically into the mixing chamber 7, when sediment scales 15 have collected in front of the constriction 10.

With the above described two-component nozzles and the corresponding operation method, inspection and maintenance task on the two-component nozzle systems can be reduced to a minimum and an optimum atomisation can be ensured over long operating periods.

Figure 7:
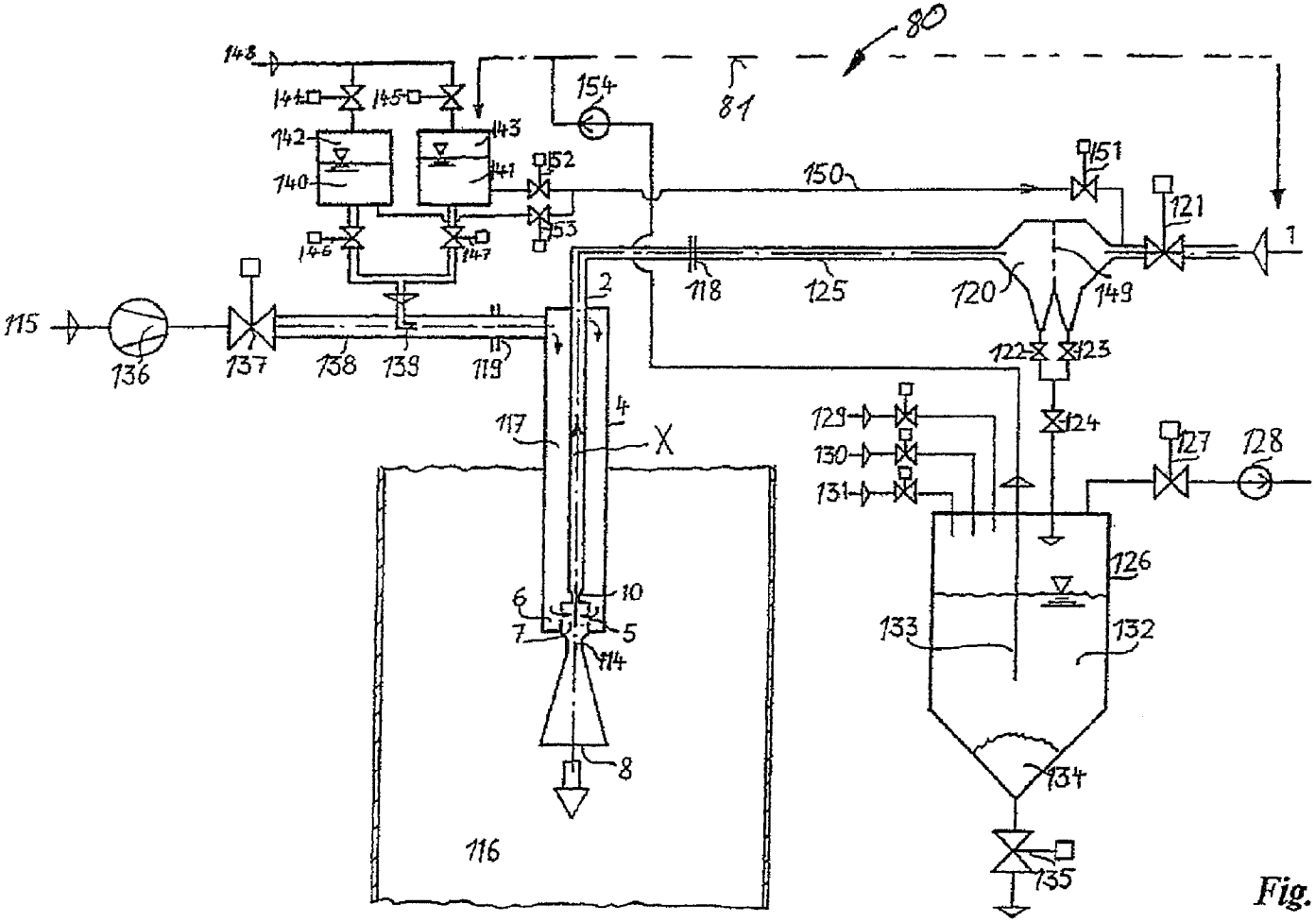
FIG. 7 is a schematic view of a spray device according to the invention.

In the schematic illustration of FIG. 7, a spray device 80 according to the invention is depicted, based on a preferred embodiment. In the past, two-component nozzles were frequently used for evaporation of the suspension incurred in wet flue-gas cleaning systems. Therefore, it was possible to offer an effluent-free method. Lately however, the flue-gas cleaning itself is increasingly being carried out in such apparatus that are equipped with two-component nozzles. In this case, the liquid 1 to be sprayed must be enriched with an absorbing substance, for instance, with limewater in order to effect the entrainment of acidifiers such as sulphur dioxide and hydrogen chloride. With an advantageous limewater concentration, for example, of 10% for the flue-gas cleaning process, the pollution risk for the pipelines and for the nozzle lances and nozzles is significantly increased, so that sediments can occur.

These sediments impermissibly impair atomisation, so that substantially larger droplets occur, than would be the case with nozzles without incrustation. Large droplets are not only disadvantageous for the flue-gas cleaning process, since they offer a small surface for pollutant absorption; they also need a substantial evaporation time, so that they cannot generally be evaporated on-the-fly. As such, the risk of sludging or incrustation of downstream components exists, for example of a textile filter or a fan. Therefore, such sediments compel frequent removal and cleaning of nozzle lances and nozzles. Since the systems in which the nozzles are fitted cannot be generally shut down for the purpose of cleaning the nozzles, these cleaning constraints limit the application of the two-component nozzles substantially, since a negative pressure must normally prevail in the system at the nozzle insertion flange, so that no hazardous gases can exit at the briefly opened flange in order to remove the nozzle lances, or complicated sluices must be installed. Furthermore, the maintenance work necessitates a significant length of period. In addition, the function of the system can be impaired by the removal of a nozzle lance to facilitate maintenance work. By means of the spray device according to the invention as depicted in FIG. 7, and a corresponding operating method, the nozzle lance and a section of the liquid supply line can be cleaned.

As already explained, besides the scales that have occurred through sedimentation in the two-component nozzles themselves, also cross-sectional clogging occurs through sedimentation scales from the supply line to the nozzle lance as well as from the nozzle lance themselves. The scales from the supply lines to the nozzle lances can be eliminated with the help of a coarse filter. The mesh size of this filter must be smaller than the narrowest cross-section at the liquid inlet into the mixing chamber.

Since sediments can also occur in the nozzle lances themselves and as a result, plate-shaped scales can occur, according to the state of the art, in order to prevent disturbances, a further filter must be integrated directly in front of the mixing chamber inside the two-component nozzle. According to the invention, sediments at the liquid inlet into the mixing chamber can be disintegrated, as described, for example, based on FIG. 5. The space is not adequate for accommodating a filter near the two-component nozzle. Furthermore, one of such filters must be cleaned from time to time. This would likewise require the removal of the nozzle lance, which actually has to be prevented.

With the spray device of FIG. 7, the sediment-threatened areas of the nozzle lance and the nozzle must be cleaned intermittently, without the nozzle lance in this case having to be removed. This is attained according to the invention by reversing the flow direction in the liquid supply to the nozzle, back flushing of loose sediments is connected with a particles separator located in the supply line towards the nozzle lance. This cleaning process can still be improved through a chemically active cleaning liquid.

In the illustration of FIG. 7 is a two-component nozzle lance 117 according to the state of the art, with the connection flange 118 for the liquid to be atomised, and equipped with connection flange 119 for pressurised gas that activates the atomisation process.

In the liquid supply line 125 is a coarse meshed filter 120 that acts on both sides. With the help of a main liquid valve 121, the liquid supply nozzle lance 117 can be controlled or interrupted. For the purpose of sludging particles that were separated in the filter 120, the cleaning valves 122, 123 and a sludging valve 124 towards the sludge-collection tank 126 can be opened. Using a pump 128 and a negative pressure valve 127, the sludge-collection tank can be brought to the negative pressure level. In the sludge-collection tank 126, solid substances or thickened sludge 134 and sludge draining liquid 132 are collected. Whilst the thickened sludge 134 can be drained via a shut-off valve 135, the possibility exists to recirculate the sludge draining liquid 132 with the cleaning additives contained in it, i.e., the cleaning liquid used is recirculated via a line 133. With the help of the pump 154, the sludge draining liquid 132, which contains a large proportion of used cleaning liquid is pumped into a backpressure tank and hence used once again for cleaning purposes. In the case of parallel connection of several two-component nozzle lances 117, the sludge-collection tank 126 can be used as a central unit for accommodating the sludge and the cleaning liquid. This is hinted by the supply lines with the reference numbers 129, 130 and 131.

The pressurised gas 115 for atomising the liquid is supplied by the compressor 136 and fed in via the pressurised gas main valve 137 into the pressurised gas supply line 138. Here, the cleaning liquids 140 and 141 that are stored in the tanks 142 and 143 can also be fed in at a point 139. To feed in the cleaning liquid into the pressurised gas, the pressure inside the reservoirs 142 and 143 must be a bit higher than that of the pressurised gas. That is why pressurised gas exposure 148 of the tank is provided via the valves 144 and 145. Cleaning liquid can be fed in selectively via the valves 146 and 147 in the pressurised gas line 138. The cleaning liquids are entrained by the pressurised gas flow and carried via the through bores 5 for the pressurised gas, initially into the mixing chamber 7.

As already mentioned, the sludge draining liquid 132 can be recirculated and is then pumped, for example, by the pump 154 into one of the tanks 142, 143.

In a spraying operation, the liquid 1 to be atomised is then pumped whilst main liquid valve 121 is open through the liquid supply line 125 towards the nozzle lance 117. At the same time, ambient air 115 gets into the line 138 through the valve 137 and the pressurised gas supply line 4 of the nozzle lance 117 by means of the compressor 136. In a spraying operation, no cleaning liquid is generally fed in via the inlet point 139. The pressurised gas gets into the ring chamber 6, which at least surrounds the mixing chamber 7 at least section-wise and via the through bores 5 into the mixing chamber 7. The liquid to be atomised shoots through the constriction 10 of the liquid inlet bore centrally and symmetrically into the mixing chamber 7. A further constriction 114 closes the mixing chamber 7 towards the nozzle output 8. After the constriction 114, an output funnel adjoins, so that through the nozzle output 8 a spray jet exits into the process surrounding 116.

To set a cleaning operation, first a main liquid valve 121 is switched off and then the cleaning valves 122, 123, 124 are opened. The pressurised gas supply is further sustained and via the inlet point 139 the cleaning liquid is fed in from the tanks 142, 143 so that in the pressurised gas supply line 4 a mixture of cleaning liquid and pressurised gas is provided, and especially ambient air 115. In the case of a closed shut-off main liquid valve 121 and opened cleaning valves 122, 123, 124, at least a part of the pressurised gas is pumped with the cleaning liquid via the mixing chamber 7 through the lance pipe 2 and the supply line 125 in direction of the arrow "X" in FIG. 7 towards the filter 120 and drained out from here into the sludge-collection tank 126. A part of the cleaning fluid, the mixture of pressurised gas, cleaning liquid and rest of the liquid to be atomised inside the lance pipe 2 flows through a filter disc 149 backwards, which is also cleaned. If necessary, the cleaning valve 132 can be temporarily throttled back at this point, in order to divert the cleaning fluid increasingly through the filter disc 149.

In the cleaning operation in contrast to the spraying operation, a flow reversal in the liquid supply line, the lance pipe 2 and the supply line 125 towards the filter is attained. Through this, clogging bits inside the constriction 10 can be transported away reliably and drained via the filter 120 into the sludge-collection tank 126. The liquid in the liquid supply line can thereby be transported back to the filter alone by the overpressure developed inside the mixing chamber 7 by the incoming evaporation air.

The pressurised gas inflowing into the mixing chamber 7, in the cleaning operation can in principle flow out via two openings from the mixing chamber 7, once via the somewhat larger constriction 114 of the mixing chamber 7 into the gas space 116 or via the constriction 10 into the liquid supply line, namely the lance pipe 2 and then towards the filter 120 or towards the sludge-collection tank 126. Investigations by the inventor have shown that the dynamic pressure of the atomizing air flowing towards the filter 120 is generally sufficient for transporting the plate-shaped scales in the area of the constriction 10 together with the liquid 1 still available in the liquid supply line, in the lance pipe 2, back to the filter 120. One can intensify the cleaning-air stream by applying a negative pressure at the sludge-collection tank 126, what, as already described, occurs by opening the valve 127 and activating the pump 28.

The cleaning effect can be intensified by applying pressure surges to the cleaning fluid. For this purpose, one of the valves can be designed as a diaphragm valve between the mixing chamber 7 and the sludge-collection tank 126.

In FIG. 7, a valve 151 is provided in the main in-feed line 150 that serves to supply cleaning liquid from the reservoir tanks 142 and 143 to the upstream side of the filter 120. A pair of valves 152 and 153 allows cleaning liquid to be selectively supplied from a selected reservoir tank 142/143 for direct in-feed to the main in-feed line 150 so that the valve 151 can thus facilitate a direct in-feed of cleaning liquid to the upstream side of the filter 120 for input into the liquid supply pipe 2.

When the intention is not to only transport loose particles back to the sludge blow-off unit, but also to dissolve firmly stuck sediment scales from the nozzle and walls of the liquid supply line in the nozzle lance 117, it is necessary to admix atomising air with the cleaning liquid as described above. For this purpose, e.g. acids or leach come in question, which are stored in the controllable tanks 142, 143. For a parallel connection of several nozzle lances, the possibility also exists of a central supply with cleaning liquid, as is also principally the case for sludge blow-off 126.

During the cleaning operation with the cleaning liquid fed into the pressurised gas supply line, cleaning liquid can also flow out of the nozzle orifice 8. This is generally also desired in order to dissolve sediment scales in the orifice area of the nozzle. The cleaning liquid that enters into the gas space 116 via the nozzle orifice 8, also in the cleaning operation, fine atomisation occurs such that it poses no danger to downstream components since the droplets evaporate in good time. Besides that fact, according to the invention, the partial flow of the cleaning fluid exiting the nozzle orifice 8 can be lowered arbitrarily further away by applying a sufficiently low negative pressure at the sludge-collection tank 126. If necessary, also the pressure of the atomising air can be reduced accordingly.

In an embodiment of a method for operating the spray device 80 through sufficiently large reduction of the negative pressure in the sludge-collection tank 126, gas can be sucked via the nozzle orifice 8 through the liquid supply line, the lance pipe 2, and the supply line 125, to the nozzle lance 117, provided this does not appear disadvantageous according to the composition of the gas in the gas space 116, for example a suitable flue-gas composition. In a manner not depicted, two-component nozzle lances are frequently not only charged with the liquid to be atomised and the pressurised gas, but also with cladding air, which is conveyed in a pipe that concentrically encloses the two-component nozzle lance. This cladding air then encloses the nozzle orifice during operation. When gas is sucked back during the cleaning operation, in this case, not the flue gas must be sucked back via the nozzle lance. Rather, the gas that is sucked back can consist of neutral cladding air. When sucking back the cladding air, the possibility therefore exists to clean the nozzles and nozzle lances without the cleaning liquid entering the flue gas. In addition, flue gas must not always be present inside the gas room 16. In the foodstuff processing technology, a strong interest can exist in that no cleaning liquid should be allowed to penetrate into the system parts that are exposed to foodstuff.

As already mentioned, the cleaning liquid that contributes the largest percentage of the sludge draining liquid 132 in the sludge-collection tank 126 can be recirculated via the pipeline 133 and the pump 154 until their absorption capacity is exhausted by considering the economic viability aspects. Therefore, the cleaning liquid should only be blown in so far via the nozzle orifice 8 into the gas space 116, as this is conducive or necessary to the process or the cleaning of the nozzle orifice 8.

Alternatively, during a cleaning operation, the cleaning liquid can be sucked exclusively also by applying a corresponding negative pressure to the sludge-collection tank 126 and closing the pressure gas valve 137. A cleaning fluid then exclusively consists of cleaning liquid and it is possible to rinse the spray device 80 with the cleaning liquid. The cleaning liquid is then not fed into the pressurised gas, but the pressurised gas is fully switched off, so that the pressurised gas side is exclusively exposed to the cleaning liquid. By modulating a negative pressure operation of the sludge blow-off, the cleaning liquid would likewise then be fed backwards via the supply air bores 5 and the mixing chamber 7 through the lance pipe 2 for the liquid supply to the filter 120. In the process, to a certain extent, also the gas from the gas space 116 could be sucked back via the nozzle orifice 8.

To be able to offer an effluent-free method, also the sludge draining liquid 132, which, in fact also consists of the cleaning liquid, must finally also be evaporated. This can happen by mixing the sludge draining liquid 132 in the main liquid flow 1 during the spraying operation. Dosing the sludge draining liquid 132 into the main liquid flow 1 occurs thereby, appropriately, in that the sludge draining liquid 132 flows out of the nozzle orifice 8 after being diluted to ineffectiveness. In the illustration of FIG. 7, the sludge draining liquid can be drawn via the line 133 and admixed by means of the pump 154 and the dash-outlined supply line 81 of the liquid 1 to be atomised. For extreme impurities and sediments, also much cleaning liquid can be fed by means of the supply line 81, such that practically only the cleaning liquid is conveyed to the mixing chamber 7, and thus effects thorough cleaning.

The invention claimed is:

1. A method of operating a spray nozzle comprising the steps of:

providing a spray nozzle comprising a mixing chamber and at least two through bores leading to the mixing chamber, each through bore being connected to a fluid line, at least one of the through bores being formed for a self-cleaning process and/or devices are provided for cleaning at least one of the through bores;

providing a pressurized gas supply line leading to the mixing chamber as one of the fluid lines upstream of one of the through bores formed as a pressurized gas inlet bore;

providing a liquid supply line leading to the mixing chamber as one of the fluid lines;

introducing a liquid into the liquid supply line;

introducing a pressurized gas into the pressurized gas supply line to alter a spray characteristic of the liquid exiting the mixing chamber and spray nozzle;

providing a tank for holding a cleaning liquid that is separate from the liquid being supplied to the liquid supply line and separate from the gas being supplied to the pressurized gas supply line;

introducing the cleaning liquid from the tank into the pressurized gas supply line upstream of the mixing chamber;

introducing the cleaning liquid from the tank into the liquid supply line upstream of the mixing chamber; and passing the cleaning liquid through the liquid supply line and the pressurized gas supply line and then into the mixing chamber before exiting to the spray nozzle.

2. The method according to claim 1, further including introducing steam upstream of the pressurized gas inlet bore.

3. The method according to claim 1, further including introducing abrasively acting dust particles upstream of the pressurized gas inlet bore.

4. The method according to claim 1, further including modulating pressure surges in a liquid to be atomised in the liquid supply line upstream of one of the through bores formed as a liquid inlet bore.

5. The method according to claim 4, further including modulating pressure surges in the ultrasonic range.

* * * * *